US006302125B1

(12) United States Patent
Lin et al.

(10) Patent No.: US 6,302,125 B1
(45) Date of Patent: Oct. 16, 2001

(54) SIMPLIFIED FLAT TOP UMBRELLA WITH ONE-PIECE UMBRELLA CLOTH

(75) Inventors: Chung-Kuang Lin; Jung-Jen Chang, both of Taipei Hsien (TW)

(73) Assignee: Fu Tai Umbrella Works, Ltd., Taipei Hsein (TW)

( * ) Notice: Subject to any disclaimer, the term of this patent is extended or adjusted under 35 U.S.C. 154(b) by 0 days.

(21) Appl. No.: 09/552,008

(22) Filed: Apr. 19, 2000

(51) Int. Cl.[7] ..... A45B 25/18
(52) U.S. Cl. ..... 135/33.2; 135/33.5; 135/27
(58) Field of Search ..... 135/23, 27, 29, 135/31, 32, 33.2, 33.5

(56) References Cited

U.S. PATENT DOCUMENTS

D. 373,465 * 9/1996 Chipman ..... 135/25.1
1,156,709 * 10/1915 Rose ..... 27/33.2
2,788,792 * 4/1957 Koller ..... 135/33.2
5,213,123 * 5/1993 Whitfield ..... 135/27
5,421,354 * 6/1995 Bolton ..... 135/19.5
5,806,546 * 9/1998 Ni ..... 135/33.2
6,058,952 * 5/2000 Lin ..... 135/29

* cited by examiner

*Primary Examiner*—Beth A. Stephan
(74) *Attorney, Agent, or Firm*—Dougherty & Troxell

(57) ABSTRACT

A simplified flat top umbrella for simulating a bottle cap of drink or beverage includes: a rib assembly pivotally secured to a central shaft having at least a top rib and an outer rib operatively extended to form a horizontal rib frame having an outer rib portion generally perpendicular to the horizontal rib frame; and an one-piece umbrella cloth secured to the horizontal rib frame for forming a flat top surface for printing decorative or advertising features thereon such as a logo of a drink or beverage and having a skirt portion of the umbrella cloth secured to the outer rib portion by forming a plurality of radial ruffles and ridged rumples radially formed on a periphery of the skirt portion for vividly simulating the ruffles as circumferentially formed on a perimeter of a bottle cap such as cap of drink or beverage bottle.

1 Claim, 5 Drawing Sheets

SIMPLIFIED FLAT TOP UMBRELLA WITH ONE-PIECE UMBRELLA CLOTH

BACKGROUND OF THE INVENTION

U.S. Patent application entitled "Simplified Flat Top Umbrella" as filed on: Dec. 2, 1998 with a serial number of: 09/204,755 (hereinafter called "the prior application") was also invented by the same inventors of this application, and is opened to extend the ribs to lift the top rib 2 and the outer rib 3 to form a generally horizontal canopy and the outer portion 32 of the outer rib 3 is pulled inwardly by the pulling rib 5 and the stretcher rib 4 to form a skirt portion generally perpendicular to the horizontal canopy in order to provide a flat top umbrella, which may be used for decorative or advertising purpose, for instance, to simulate the bottle cap C as shown in FIG. 1 attached to this application.

However, the prior application did not disclose the umbrella cloth suitably provided for making an article such as the bottle cap C as shown in FIG. 1 having the advertising feature printed on the fat top surface T and having ruffles R circumferentially formed on a perimeter of the outer skirt portion.

For making an umbrella for simulating the bottle cap C as shown in FIG. 1, a method for making the conventional umbrella cloth may be taken into consideration by sewing S a plurality of triangular gores G to form the canopy of the umbrella U as shown in FIG. 2. Still, there is lacking of the ruffles R (FIG. 1) disposed around the perimeter of the canopy. For further making such ruffles R, it will require complex and cost-increasing production steps. Moreover, for sewing S all the gores G by threads along every two neighboring gores in order to assemble an umbrella canopy, it will also increase the production cost.

It is therefore invented by the present inventors for making a flat top umbrella having the canopy formed by an one-piece umbrella cloth.

SUMMARY OF THE INVENTION

The object of the present invention is to provide a simplified flat top umbrella for simulating a bottle cap of drink or beverage including: a rib assembly pivotally secured to a central shaft having at least a top rib and an outer rib operatively extended to form a horizontal rib frame having an outer rib portion generally perpendicular to the horizontal rib frame; and an one-piece umbrella cloth secured to the horizontal rib frame for forming a flat top surface for printing decorative or advertising features thereon such as a logo of a drink or beverage and having a skirt portion of the umbrella cloth secured to the outer rib portion by forming a plurality of radial ruffles and ridged rumples radially formed on a periphery of the skirt portion for vividly simulating the ruffles as circumferentially formed on a perimeter of a bottle cap such as cap of drink or beverage bottle.

DETAILED DESCRIPTION

Figure 1:
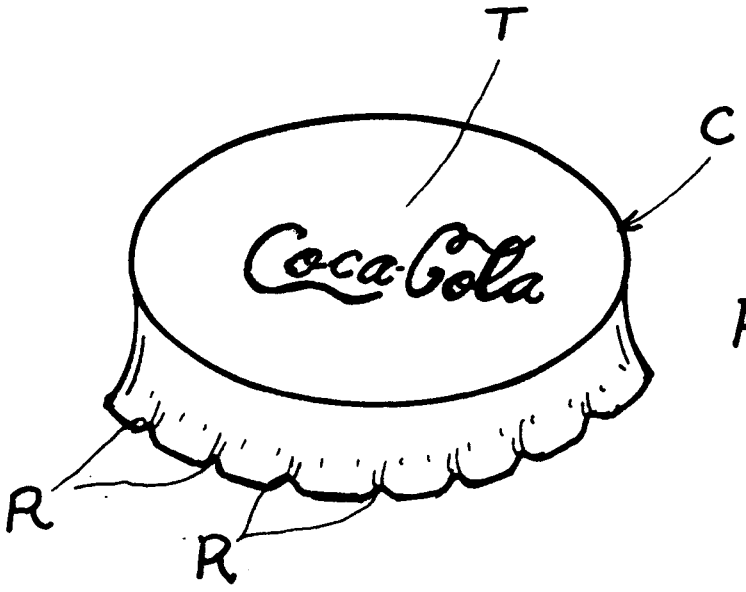
Fig. 1 PRIOR ART
FIG. 1 shows a conventional bottle cap.
Figure 2:
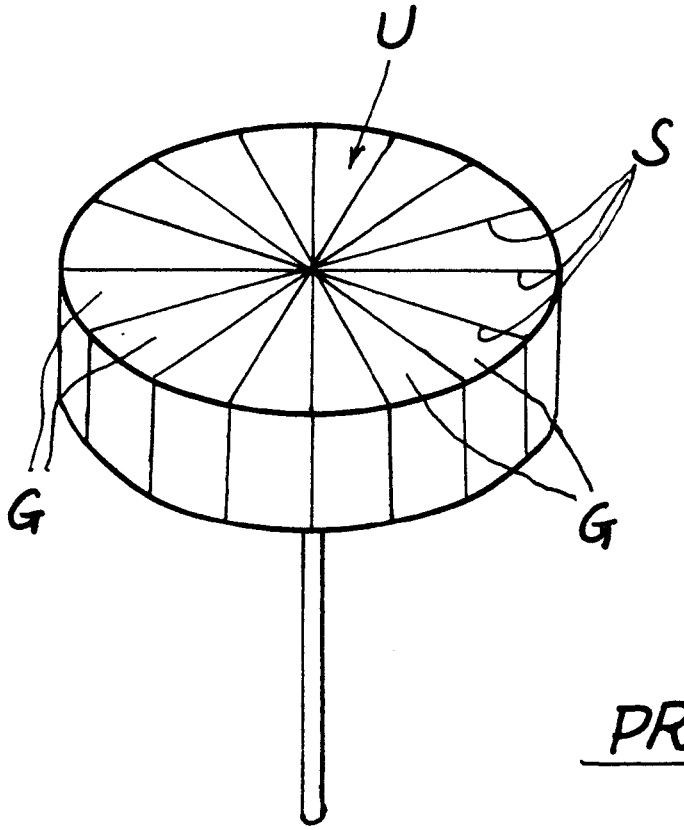
PRIOR ART Fig. 2
FIG. 2 shows an umbrella inferentially made for simulating the bottle cap as shown in FIG. 1.

As shown in FIGS. 3~8, the present invention comprises: a rib assembly 200 pivotally secured to a central shaft 1; and an one-piece umbrella cloth 100 secured on the rib assembly 200.

The rib assembly 200 may be directly used from the prior application, U.S. Ser. No.: 09/204,775, which is still described briefly hereinafter.

The rib assembly 200 includes: a top rib 2 pivotally secured to an upper notch 11 of the central shaft 1, an outer rib 3 connected to the top rib 2 and radially protruding outwardly from the top rib 2, a stretcher rib 4 pivotally connected between the top rib 2 and a lower runner 12 slidably held on the central shaft 1, and a pulling rib 5 pivotally connected between the stretcher rib 4 and the outer rib 3.

The outer rib 3 has an inner portion 31 secured to the top rib 2, an outer portion 32 operatively bent downwardly to be generally perpendicular to the inner portion 31 of the outer rib 3, and a flattened portion 33 formed to be a flat plate portion between the inner portion 31 and the outer portion 32 adapted to help a smooth downward bending of the outer portion 32 of the outer rib 3 and to support an annular bending portion 101*a* of the umbrella cloth 100 when secured on the rib assembly 200.

Figure 5:
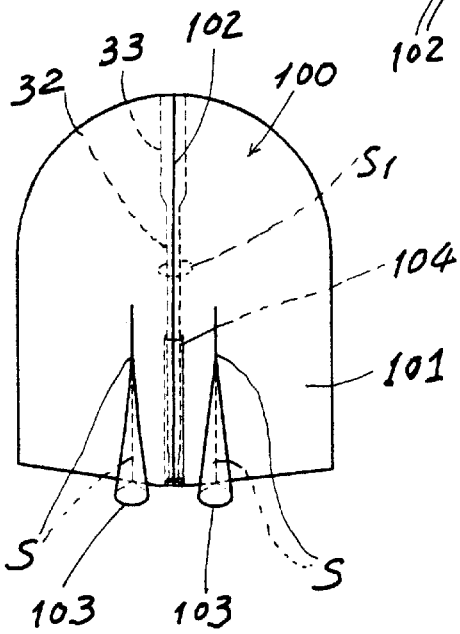
FIG. 5 is a partial enlarged view of the present invention from FIG. 4.
Figure 6:
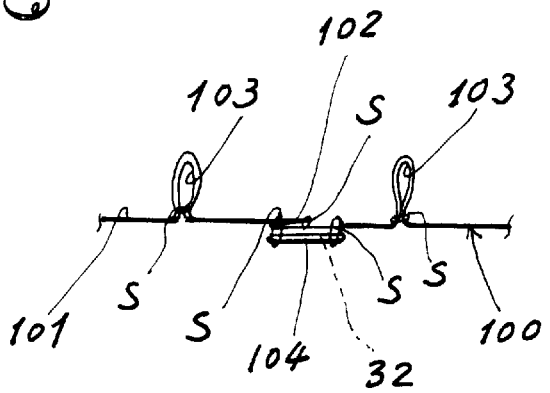
FIG. 6 is a bottom view as viewed from a bottom side of FIG. 5.
Figure 7:
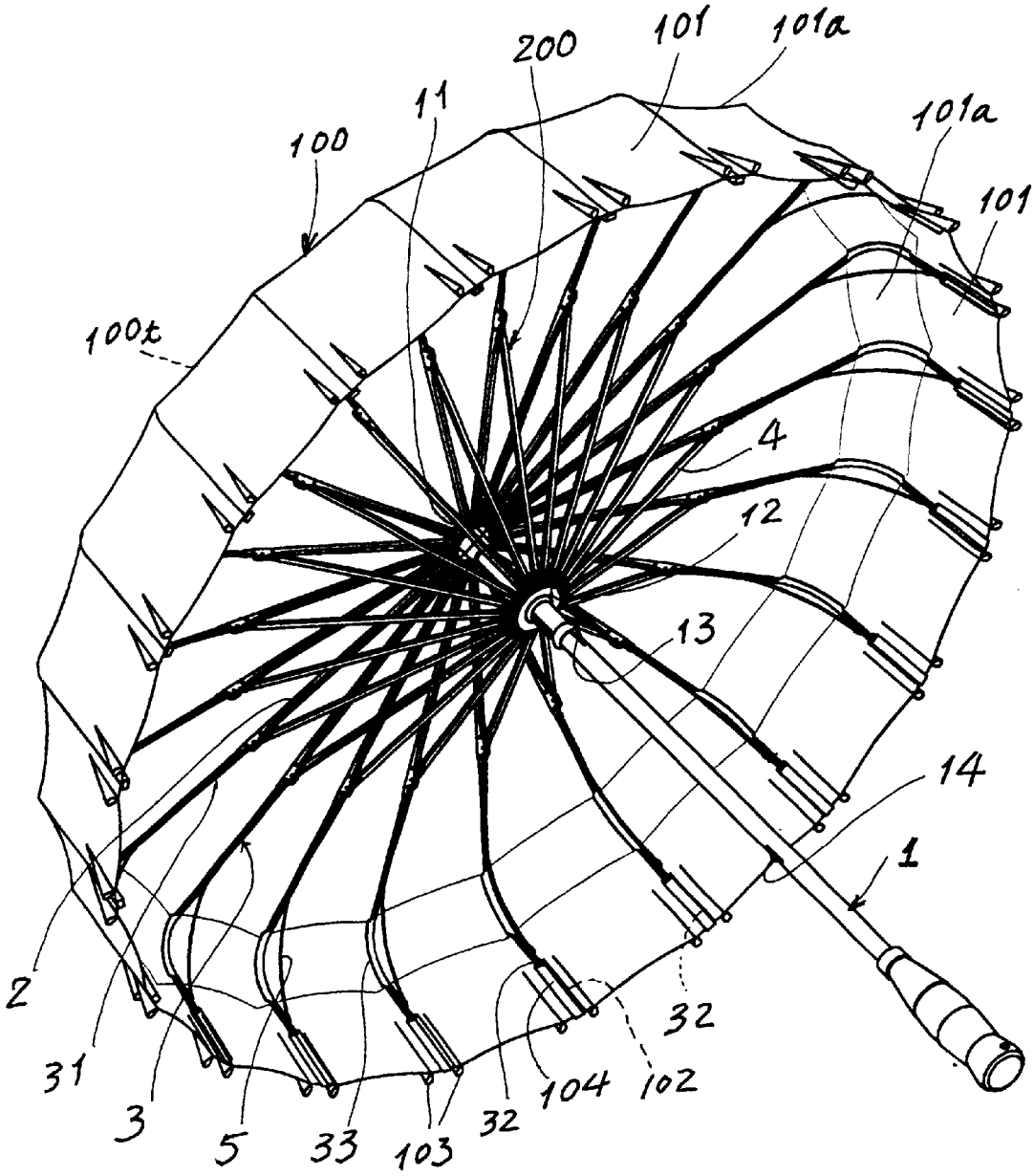
FIG. 7 is a perspective view of the present invention as viewed from a bottom side of FIG. 1 or 2.

The one-piece umbrella cloth 100 includes: a flat top portion 100*t* horizontally secured on the top rib 2 and the inner portion 31 of the outer rib 3 when straightly extended when opening the umbrella; a skirt portion 101 downwardly bent about an annular bending portion 101*a* to be generally perpendicular to the flat top portion 100*t* when opening the umbrella; a plurality of radial ruffles 101 each ruffle radially pleated on the skirt portion 101 and fixed on the skirt portion 101 by sewing S threads on the skirt portion, especially as shown in FIG. 5, 6; a plurality of ridged rumples 103 each rumple generally parallel to each radial ruffle 102 and ridged radially outwardly from the skirt portion 101 and fixed on the skirt portion by sewing S threads on the skirt portion; with the radial ruffles 102 and ridged rumples 103 radially pleaded on the skirt portion 101 of the umbrella cloth 100 to form a generally cylindrical shape of the skirt portion 101 to eliminate the unexpected wrinkles on the skirt portion as downwardly bent from the flat top portion 100*t* of the umbrella cloth 100 except the ruffles 102 and rumples 103; and a plurality of rib sleeves 104 each sleeve 104 fixed on an inside portion of the skirt portion 101 by sewing S threads through the sleeve 104 and the skirt portion 101 as shown in FIG. 5~7, each rib sleeve 104 provided for inserting each outer portion 32 of the outer rib 3 in the sleeve 104 and further fastened by sewing threads or fastener S1 as shown in FIG. 5.

The outer portion 32 of outer rib 3 is inserted into the sleeve 104, which has a close-end bottom, thereby being "concealed" in the sleeve 104 without protrusion outwardly beyond a perimeter of the umbrella cloth and rib assembly for vividly simulating a bottle cap such as bottle cap of coca cola, etc.

When opening the present invention, the runner 12 is raised to upwardly move the stretcher rib 4 to drag the pulling rib 5, thereby extending the top rib and the outer rib 3 and allowing the pulling rib 5 to pull the outer portion 32 of the outer rib 3 downwardly inwardly to be generally perpendicular to the outer rib 3 and top rib 2 which are generally straightened horizontally until the runner 12 is locked on the shaft 1 by engaging an upper catch 13 resiliently protruding from the shaft 1.

The skirt portion 101 of the umbrella cloth 100 as covered on and supported by the outer portion 32 of the outer rib 3; while the top rib 2 and the outer rib 3 will be horizontally positioned to support the flat top portion 100*t* of the umbrella cloth 100. The top flat portion 100*t* may be provided for decorative or advertising uses such as shown in FIG. 1.

Figure 8:
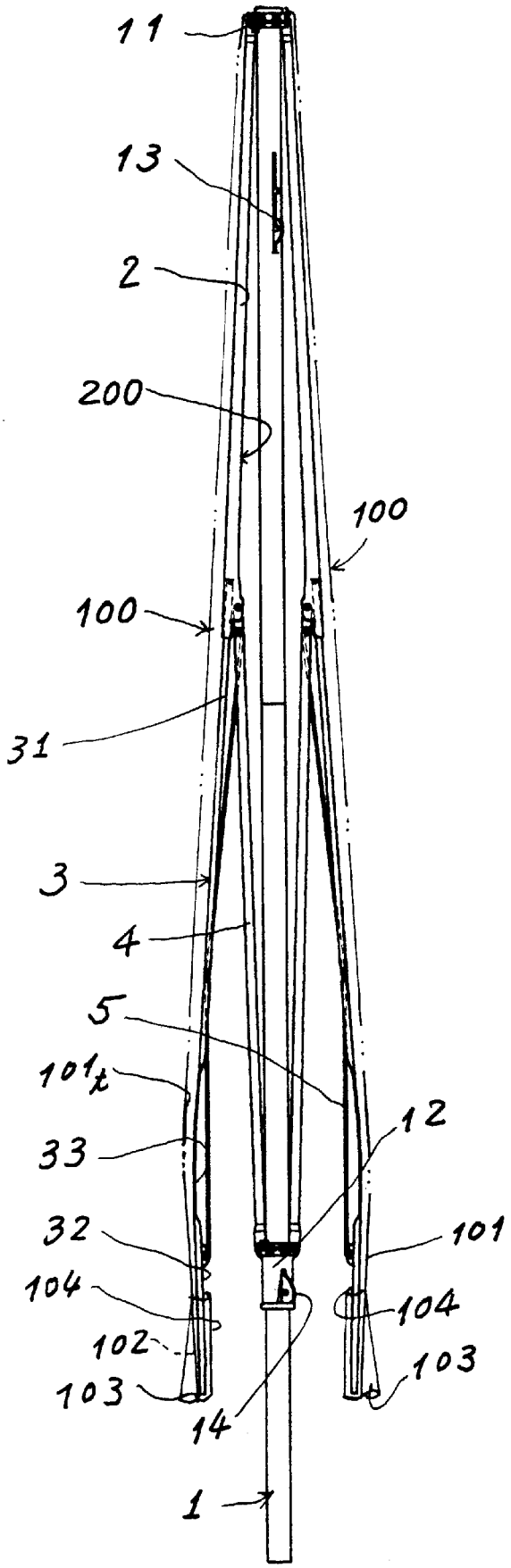
FIG. 8 shows a folded umbrella of the present invention.

When closing the umbrella as shown in FIG. 8, the runner 12 is lowered to release the pulling rib 5 and the bent outer portion 32 of the outer rib 3 until the runner 12 is locked on the lower catch 14 resiliently held in the shaft 1. The rumples 103 and the skirt portion 101 will also be retracted to approximate the shaft 1.

Figure 3:
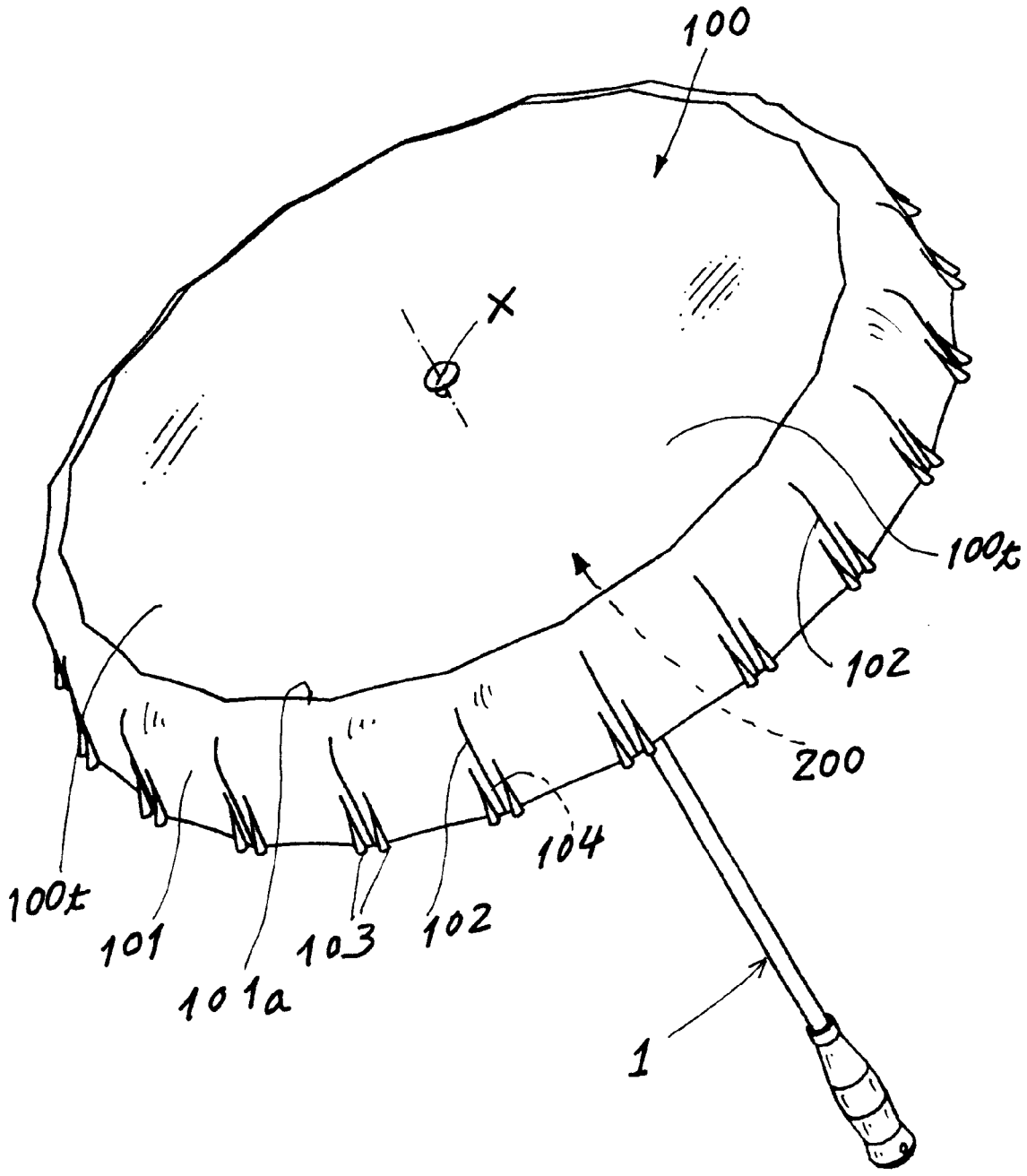
FIG. 3 is a perspective view of the present invention.
Figure 4:
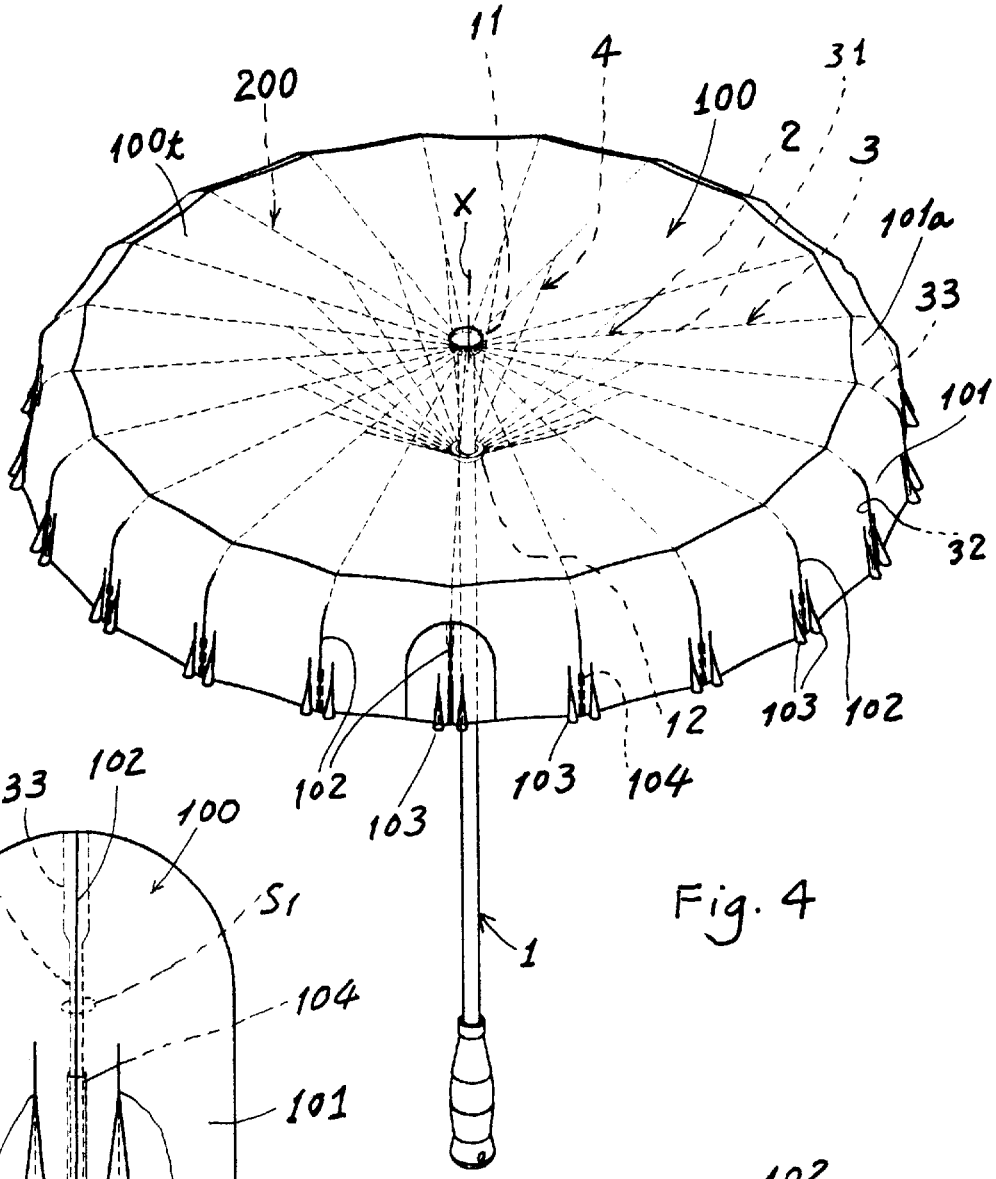
FIG. 4 is a perspective view of the present invention having the ribs illustrated in dotted lines.

When the umbrella is opened especially as shown in FIG. 3, the flat top portion 100*t* provides a big flat surface for printing decorative or advertising features thereon; and the rumples 103 may vividly simulate the ruffles R as disposed on a periphery of a bottle cap as shown in FIG. 1.

Accordingly, the present invention in addition to the prior application (U.S. Ser. No.: 09/204,755) will be very suitable for vividly simulating a bottle cap of a drink or beverage. Just by the aid of one-piece umbrella cloth 100, an umbrella canopy can be fastly made without the need by assembling a plurality of gores which require complex job and higher cost.

The present invention may be modified without departing from the spirit and scope of this invention.

We claim:

1. A flat top umbrella comprising:

a rib assembly including a top rib pivotally secured to an upper notch of a central shaft, a stretcher rib pivotally secured between the top rib and a lower runner slidably held on said shaft, an outer rib having an inner portion thereof secured to the top rib, and an outer portion connected to the inner portion of the outer rib and operatively bent downwardly to be generally perpendicular to said inner portion of said outer rib and said top rib when extended and straightened by opening the umbrella; and a one-piece umbrella cloth having a flat top portion secured to at least said top rib, a skirt portion connected to said flat top portion and secured to an outer portion of the outer rib, and a plurality of radial ruffles and ridged rumples radially formed o n said skirt portion of said umbrella cloth, whereby upon downward bending of said skirt portion and said outer portion of said outer rib, said plurality of radial ruffles and ridged rumples on the skirt portion will vividly simulate a bottle cap having ruffles circumferentially formed on a periphery of the cap;

said one-piece umbrella cloth including: said flat top portion horizontally secured on the top rib and the inner portion of the outer rib when straightly extended when opening the umbrella; said skirt portion downwardly bent about an annular bending portion between said flat top portion and said skirt portion to be generally perpendicular to the flat top portion when opening the umbrella; said plurality of said radial ruffles each radially pleated on the skirt portion and fixed on the skirt portion; and said plurality of ridged rumples each generally parallel to each said radial ruffle and ridged radially outwardly from the skirt portion and fixed on the skirt portion;

the improvement which comprises;

said one-piece umbrella cloth including a plurality of rib sleeves each having a closed-end bottom and secured on an inside portion of said skirt portion of said umbrella cloth for inserting an outer portion of each said outer rib into each said rib sleeve; and each said radial ruffle and ridged rumple fixed on said skirt portion of said umbrella cloth by sewing threads on said skirt portion.

* * * * *